US010408502B2

(12) United States Patent
Xie et al.

(10) Patent No.: US 10,408,502 B2
(45) **Date of Patent: *Sep. 10, 2019**

(54) AIR CONDITIONING SYSTEM AND METHOD FOR CONTROLLING SAME

(71) Applicant: GD MIDEA AIR-CONDITIONING EQUIPMENT CO., LTD., Foshan, Guangdong (CN)

(72) Inventors: Ligao Xie, Guangdong (CN); Jinbo Li, Guangdong (CN)

(73) Assignee: GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 169 days.

This patent is subject to a terminal disclaimer.

(21) Appl. No.: 15/294,833

(22) Filed: Oct. 17, 2016

(65) Prior Publication Data

US 2017/0254571 A1 Sep. 7, 2017

(30) Foreign Application Priority Data

Mar. 3, 2016 (CN) ..... 2016 1 0121033

(51) Int. Cl.
*F25B 13/00* (2006.01)
*F25B 1/10* (2006.01)
*F25B 41/04* (2006.01)

(52) U.S. Cl.
CPC ..... *F25B 13/00* (2013.01); *F25B 1/10* (2013.01); *F25B 41/04* (2013.01);
(Continued)

(58) Field of Classification Search
CPC .. F25B 1/10; F25B 13/00; F25B 41/04; F25B 2313/02741; F25B 2341/0662;
(Continued)

(56) References Cited

U.S. PATENT DOCUMENTS 3,111,820 A * 11/1963 Atchison ..... F25B 31/008 417/438
3,226,940 A * 1/1966 Jekat ..... F04D 17/127 415/109

(Continued)

*Primary Examiner* — Jonathan Bradford
(74) *Attorney, Agent, or Firm* — Anova Law Group, PLLC

(57) ABSTRACT

An air conditioning system and a method for controlling the same are provided. The air conditioning system includes an enhanced vapor injection compressor, first and second direction switching assemblies, first and second heat exchangers and a flash evaporator. The enhanced vapor injection compressor has a gaseous refrigerant discharge port, a gaseous refrigerant supplement port, first and second gaseous refrigerant suction ports, and a gaseous refrigerant return port. Pressure in a sliding vane chamber of a gaseous refrigerant cylinder corresponding to the second gaseous refrigerant suction port is equal to a discharge pressure at the gaseous refrigerant discharge port. A first pipe port of the first direction switching assembly is connected with the second gaseous refrigerant suction port, a second pipe port thereof is connected with the gaseous refrigerant discharge port and a third pipe port thereof is connected with the liquid accumulator, and the first pipe port is communicated with one of the second and third pipe ports.

4 Claims, 6 Drawing Sheets

(52) U.S. Cl.
CPC ..... *F25B 2313/02741* (2013.01); *F25B 2341/0662* (2013.01); *F25B 2400/075* (2013.01); *F25B 2400/13* (2013.01); *F25B 2400/23* (2013.01); *F25B 2500/13* (2013.01); *F25B 2600/2507* (2013.01)

(58) Field of Classification Search
CPC ..... F25B 2400/075; F25B 2400/13; F25B 2500/13; F25B 2600/2507
See application file for complete search history.

(56) References Cited

U.S. PATENT DOCUMENTS

| | | | | |
|---|---|---|---|---|
| 5,056,329 | A * | 10/1991 | Wilkinson | F25B 1/10 62/197 |
| 2011/0138825 | A1* | 6/2011 | Chen | F25B 49/02 62/115 |
| 2012/0227426 | A1* | 9/2012 | Deaconu | F25B 1/10 62/115 |
| 2016/0231038 | A1* | 8/2016 | Ozu | F04C 18/356 |

* cited by examiner

AIR CONDITIONING SYSTEM AND METHOD FOR CONTROLLING SAME

RELATED APPLICATIONS

This application claims priority and benefits of Chinese Patent Application No. 201610121033.0, filed with State Intellectual Property Office on Mar. 3, 2016, the entire content of which is incorporated herein by reference.

FIELD

The present invention relates to a technical field of refrigeration equipment, and particularly, to an air conditioning system and a method for controlling the same.

BACKGROUND

With the social development and the popularity of household variable frequency air conditioners, people have higher requirements for household air conditioners, such as a quick adjustment of indoor temperature, energy conversion, powerful refrigeration at high temperature and powerful heating at low temperature. However, most ordinary variable frequency air conditioners utilize a single-rotor compressor because of the cost factor. The single-rotor compressor may generate great vibration and noise since a one-way force is imposed on the rotor, and especially the strong vibration at a low frequency may affect the reliability of the whole machine. Meanwhile, the maximum operating frequency of the air conditioner cannot be too high due to the noise limitation, and thus the maximum capacity of the air conditioner cannot be reached. If an ordinary double-rotor compressor is employed, the performance of the whole machine is poor due to the increased leakage of an air cylinder, which is not conducive to energy conservation. The ordinary double-mode compressor with double rotors may address part of the above problems, but the system performance is degraded sharply due to the increased compression ratio of the compressor in the case of refrigeration at super-high temperature and heating at super-low temperature.

SUMMARY

The present invention aims to solve one of the technical problems above in the related art to at least some extent. Thus, embodiments of the present invention provide an air conditioning system that has advantages of large power output in the case of a high frequency and a high compression ratio as well as low power and low vibration in the case of a low frequency.

Embodiments of the present invention further provide a method for controlling the above air conditioning system.

The air conditioning system according to embodiments of the present invention includes: an enhanced vapor injection compressor, a first direction switching assembly, a second direction switching assembly, first and second heat exchangers and a flash evaporator. The enhanced vapor injection compressor includes a casing, a liquid accumulator and a compressing mechanism provided in the casing, in which the casing is provided with a gaseous refrigerant discharge port, a gaseous refrigerant supplement port, a first gaseous refrigerant suction port and a second gaseous refrigerant suction port, the liquid accumulator is provided with a gaseous refrigerant return port, the gaseous refrigerant return port is communicated with the first gaseous refrigerant suction port, the first gaseous refrigerant suction port and the second gaseous refrigerant suction port are communicated with gaseous refrigerant suction channels of two gaseous refrigerant cylinders of the compressing mechanism, and pressure in a sliding vane chamber of one air cylinder of the compressing mechanism corresponding to the second gaseous refrigerant suction port is equal to a discharge pressure at the gaseous refrigerant discharge port. The first direction switching assembly includes a first pipe port, a second pipe port and a third pipe port, in which the first pipe port is connected with the second gaseous refrigerant suction port, the second pipe port is connected with the gaseous refrigerant discharge port and the third pipe port is connected with the liquid accumulator, and the first pipe port is communicated with one of the second pipe port and the third pipe port. The second direction switching assembly includes a first valve port, a second valve port, a third valve port and a fourth valve port, in which the first valve port is communicated with one of the second valve port and the third valve port, the fourth valve port is communicated with the other thereof, and the first valve port and the fourth valve port are connected with the gaseous refrigerant discharge port and the gaseous refrigerant return port respectively. The first heat exchanger has a first end connected with the second valve port and a second end, and the second heat exchanger has a first end connected with the third valve port and a second end. The flash evaporator has a gaseous refrigerant outlet, a first port and a second port, in which the gaseous refrigerant outlet is connected with the gaseous refrigerant supplement port, the first port is connected with the second end of the first heat exchanger, the second port is connected with the second end of the second heat exchanger, a first throttling element is connected in series between the first port and the first heat exchanger, a second throttling element is connected in series between the second port and the second heat exchanger, and a control valve is connected in series between the gaseous refrigerant outlet and the gaseous refrigerant supplement port.

With the gaseous refrigerant conditioning system according to the embodiments of the present invention, an operation of the enhanced vapor injection compressor with a variable capacity can be freely switched between a single-rotor operation mode and a double-rotor operation mode, such that the gaseous refrigerant conditioning system can operate in the double-rotor operation mode to improve a refrigeration or heating speed when a large power output is needed for refrigeration at high temperature and heating at low temperature, and can also bypass one rotor to operate in the single-rotor operation mode for refrigeration at low temperature and heating at high temperature, in which case low power and high energy efficiency can be realized along with slight vibration.

According to some embodiments of the present invention, the second direction switching assembly is a four-way valve.

According to some embodiments of the present invention, the first direction switching assembly is a three-way valve.

According to some embodiments of the present invention, each of the first throttling element and the second throttling element is an electronic expansion valve.

The method for controlling the gaseous refrigerant conditioning system according to the embodiments of the present invention includes the following steps: detecting an operation mode of the gaseous refrigerant conditioning system, an indoor temperature T1, an outdoor temperature T4, and a user-set temperature TS; detecting whether the outdoor temperature T4 is larger than a first set temperature T2 when the gaseous refrigerant conditioning system operates in a refrigerating mode, controlling the first direction switching assembly to communicate the first pipe port with the third pipe port if the outdoor temperature T4 is larger than the first set temperature T2, controlling the first direction switching assembly to communicate the first pipe port with the third pipe port if the outdoor temperature T4 is less than or equal to the first set temperature T2 and it is detected that a first difference value T1-TS between the indoor temperature T1 and the user-set temperature TS is larger than or equal to a second set temperature T3, and controlling the first direction switching assembly to communicate the first pipe port with the second pipe port if the outdoor temperature T4 is less than or equal to the first set temperature T2 and it is detected that the first difference value T1-TS is less than the second set temperature T3; detecting whether the outdoor temperature T4 is larger than a third set temperature T5 when the gaseous refrigerant conditioning system operates in a heating mode, controlling the first direction switching assembly to communicate the first pipe port with the third pipe port if the outdoor temperature T4 is less than or equal to the third set temperature T5, controlling the first direction switching assembly to communicate the first pipe port with the third pipe port if the outdoor temperature T4 is larger than the third set temperature T5 and it is detected that a second difference value TS-T1 between the user-set temperature TS and the indoor temperature T1 is larger than or equal to a fourth set temperature T6, and controlling the first direction switching assembly to communicate the first pipe port with the second pipe port if the outdoor temperature T4 is larger than the third set temperature T5 and it is detected that the second difference value TS-T1 is less than the fourth set temperature T6.

According to some embodiments of the present invention, the control valve is controlled to be switched on when the first direction switching assembly is controlled to communicate the first pipe port with the third pipe port; and the control valve is controlled to be switched off when the first direction switching assembly is controlled to communicate the first pipe port with the second pipe port.

According to some embodiments of the present invention, the second set temperature T3 has a same value range as the fourth set temperature T6.

Further, the value range of the second set temperature T3 is from 3° C. to 5° C., and the value range of the fourth set temperature T6 is from 3° C. to 5° C.

According to some embodiments of the present invention, the first set temperature T2 has a value range of 30° C. to 40° C.

According to some embodiments of the present invention, the third set temperature T5 has a value range of 10° C. below zero to 5° C. below zero.

Additional aspects and advantages of embodiments of present invention will be given in part in the following descriptions, become apparent in part from the following descriptions, or be learned from the practice of the embodiments of the present invention.

Figure 1:
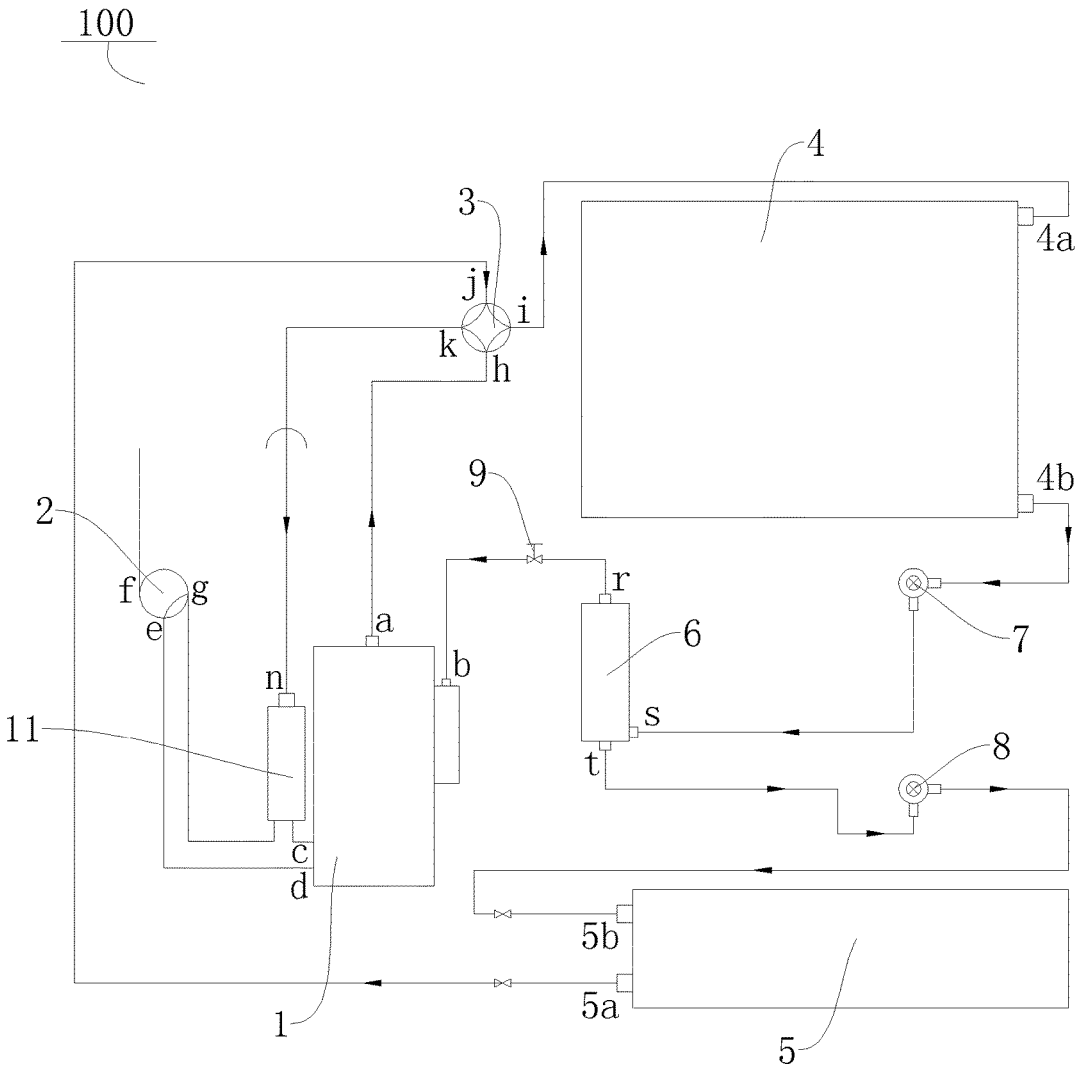
FIG. 1 is a schematic view of an air conditioning system according to an embodiment of the present invention, in which the air conditioning system is in a double-rotor refrigerating mode.

REFERENCE NUMERALS air conditioning system 1000,
enhanced vapor injection compressor 1, gaseous refrigerant discharge port a, gaseous refrigerant supplement port b, first gaseous refrigerant suction port c, second gaseous refrigerant suction port d,
liquid accumulator 11, gaseous refrigerant return port n,
first direction switching assembly 2, first pipe port e, second pipe port f, third pipe port g,
second direction switching assembly 3, first valve port h, second valve port i, third valve port j, fourth valve port k,
outdoor heat exchanger 4, indoor heat exchanger 5,
flash evaporator 6, gaseous refrigerant outlet r, first port s, second port t,
first throttling element 7, second throttling element 8,
control valve 9.

DETAILED DESCRIPTION

Embodiments of the present invention will be described in detail and examples of the embodiments will be illustrated in the accompanying drawings, where same or similar reference numerals are used to indicate same or similar members or members with same or similar functions. The embodiments described herein with reference to the drawings are explanatory, which aim to illustrate the present invention, but shall not be construed to limit the present invention.

Various embodiments and examples are provided in the following description to implement different structures of the present invention. In order to simplify the present invention, certain elements and settings will be described. However, these elements and settings are only by way of example and are not intended to limit the present invention. In addition, reference numerals may be repeated in different examples in the present invention. This repeating is for the purpose of simplification and clarity and does not refer to relations between different embodiments and/or settings. Furthermore, examples of different processes and materials are provided in the present invention. However, it would be appreciated by those skilled in the art that other processes and/or materials may be also applied.

In the following, an air conditioning system 100 according to embodiments of the present invention will be described in detail with reference to FIG. 1 to FIG. 6.

As shown in FIG. 1, the air conditioning system 100 according to embodiments of the present invention includes an enhanced vapor injection compressor 1, a first direction switching assembly 2, a second direction switching assembly 3, first and second heat exchangers (e.g. an outdoor heat exchanger 4 and an indoor heat exchanger 5 shown in FIG. 1) and a flash evaporator 6.

Specifically, the enhanced vapor injection compressor 1 includes a casing, a liquid accumulator 11 and a compressing mechanism provided in the casing, in which the casing is provided with a gaseous refrigerant discharge port a, a gaseous refrigerant supplement port b, a first gaseous refrigerant suction port c and a second gaseous refrigerant suction port d, the liquid accumulator 11 is provided with an gaseous refrigerant return port n, the gaseous refrigerant return port n is communicated with the first gaseous refrigerant suction port c, the first gaseous refrigerant suction port c and the second gaseous refrigerant suction port d are communicated with gaseous refrigerant suction channels of two air cylinders (i.e., a first air cylinder and a second air cylinder) of the compressing mechanism, and pressure in a sliding vane chamber of one air cylinder (i.e., the second air cylinder) of the compressing mechanism corresponding to the second gaseous refrigerant suction port d is equal to a discharge pressure at the gaseous refrigerant discharge port a, such that the pressure in the sliding vane chamber of the air cylinder corresponding to the second gaseous refrigerant suction port d is always kept high.

Figure 2:
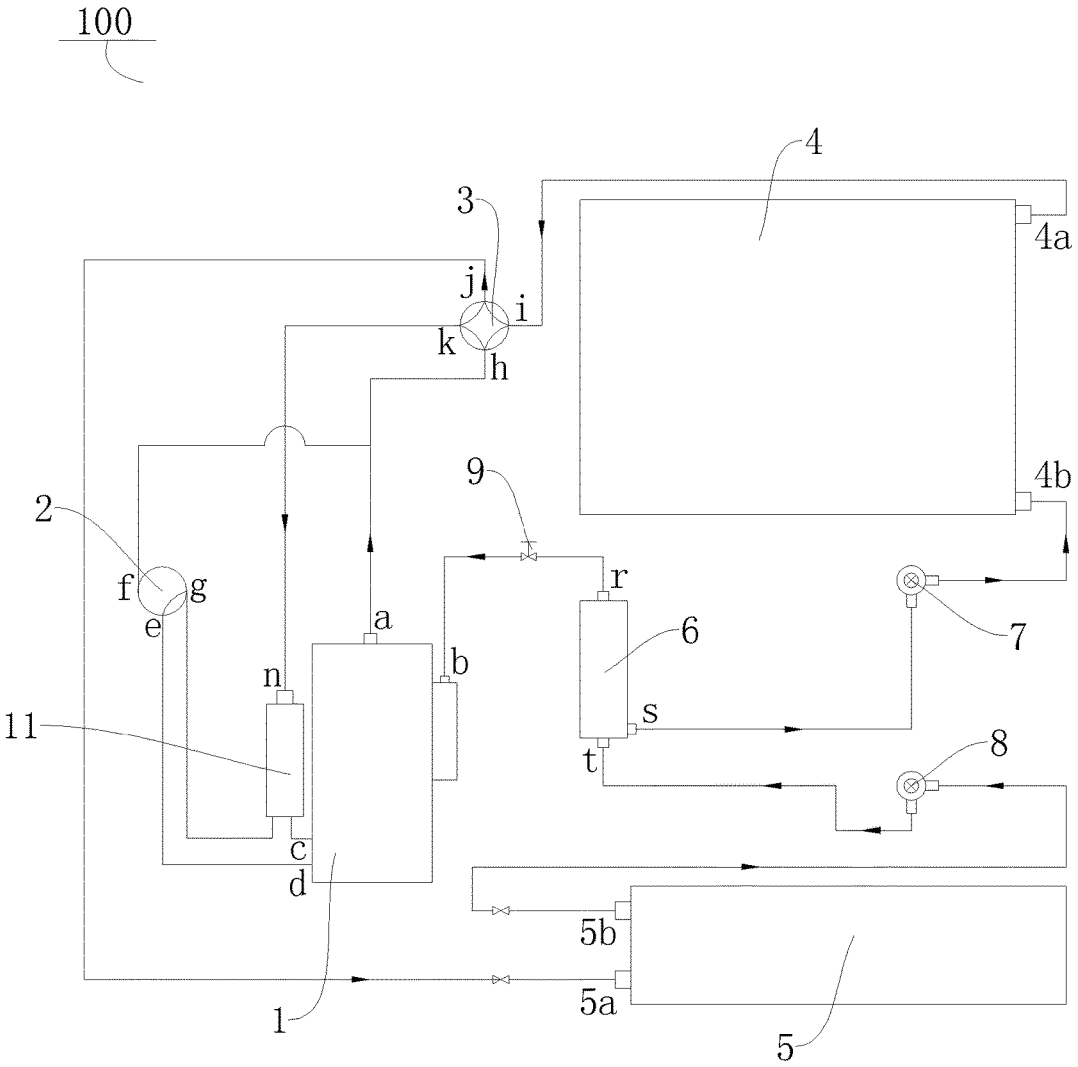
FIG. 2 is a schematic view of an air conditioning system according to an embodiment of the present invention, in which the air conditioning system is in a double-rotor heating mode.
Figure 3:
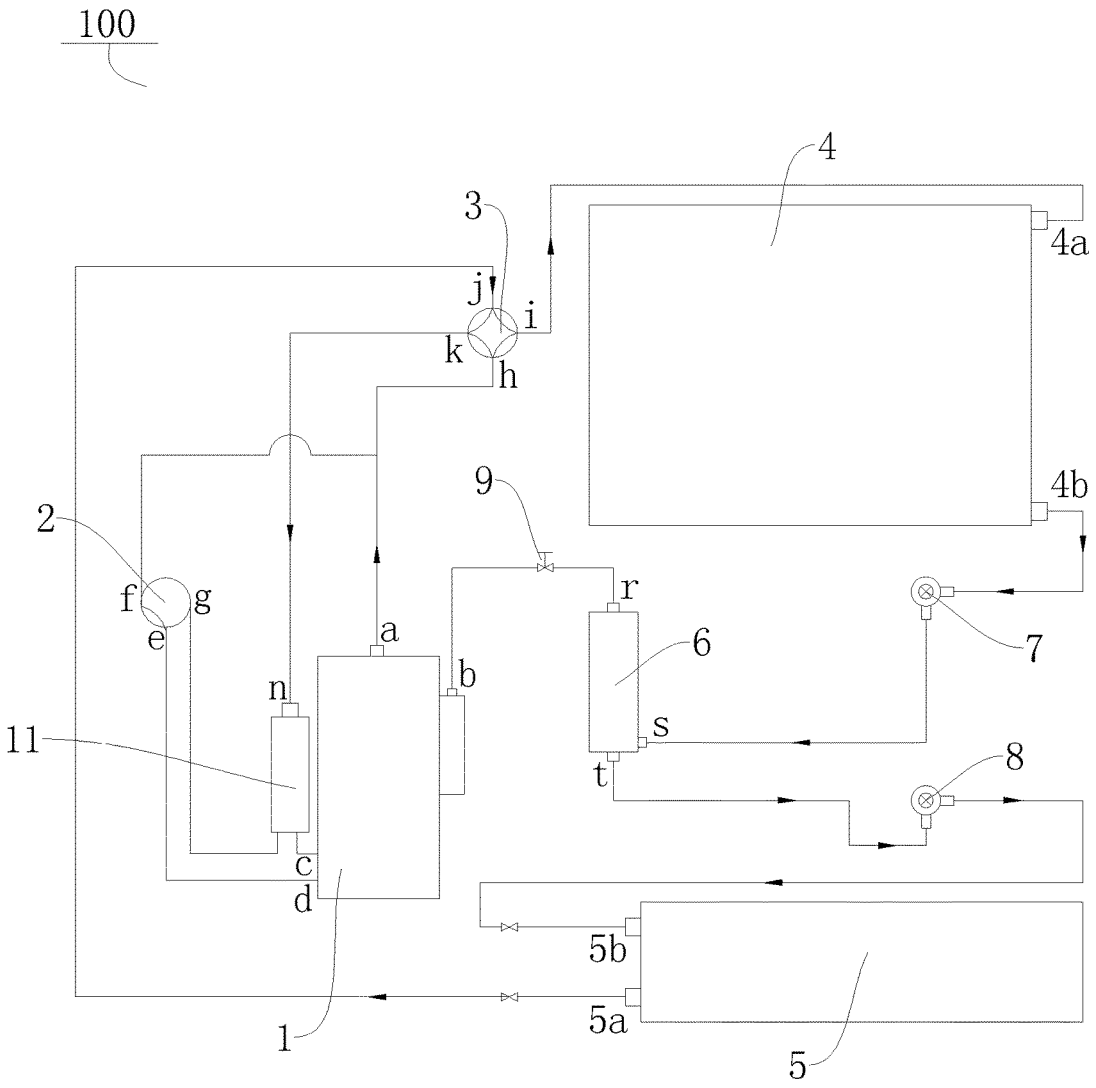
FIG. 3 is a schematic view of an air conditioning system according to an embodiment of the present invention, in which the air conditioning system is in a single rotor refrigerating mode.
Figure 4:
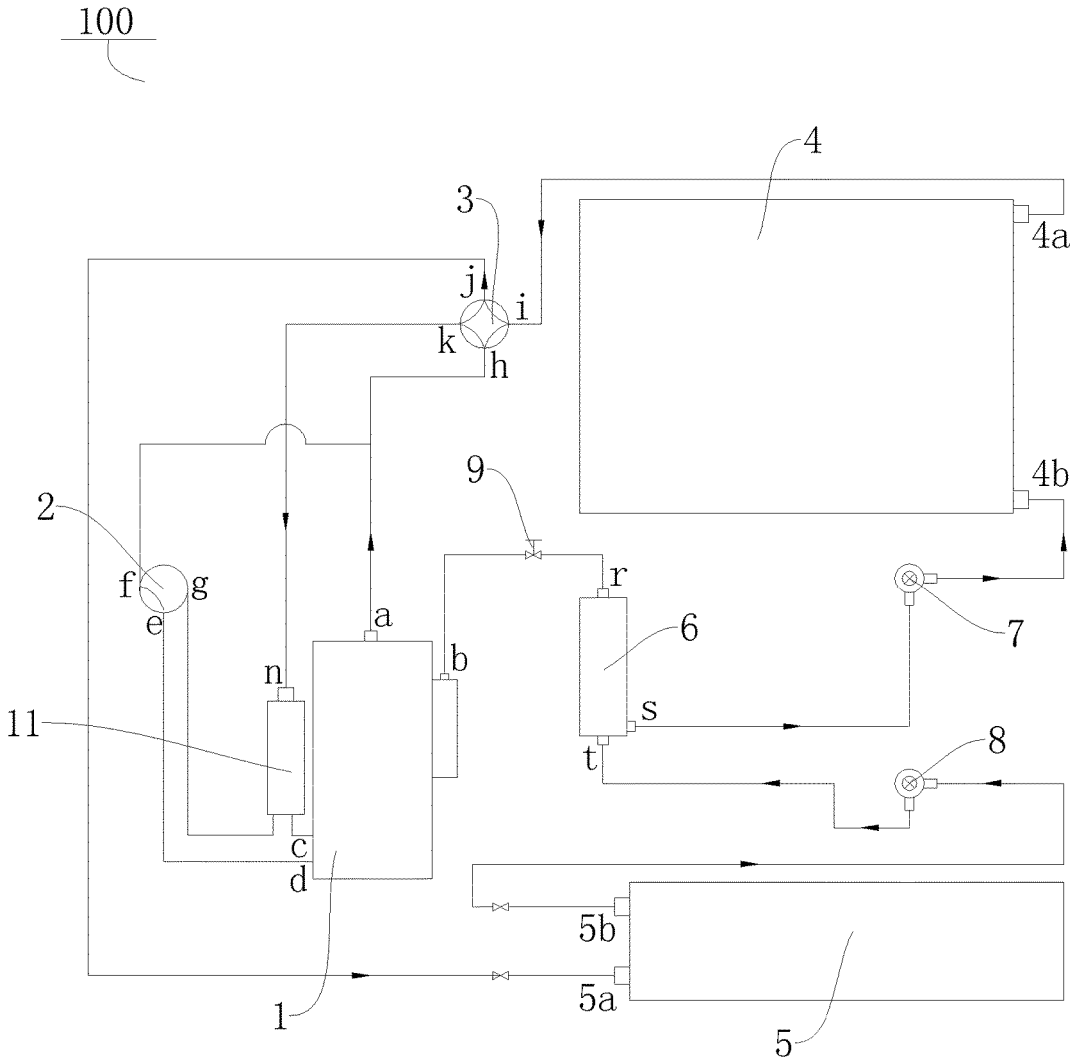
FIG. 4 is a schematic view of an air conditioning system according to an embodiment of the present invention, in which the air conditioning system is in a single rotor heating mode.

The first direction switching assembly 2 includes a first pipe port e, a second pipe port f and a third pipe port g, in which the first pipe port e is connected with the second gaseous refrigerant suction port d, the second pipe port f is connected with the gaseous refrigerant discharge port a and the third pipe port g is connected with the liquid accumulator 11, and the first pipe port e is communicated with one of the second pipe port f and the third pipe port g. As shown in FIG. 3 and FIG. 4, when the first pipe port e is communicated with the second pipe port f, the gaseous refrigerant discharge port a of the enhanced vapor injection compressor 1 is communicated with the second gaseous refrigerant suction port d, and thus pressure in the gaseous refrigerant suction channel of the air cylinder corresponding to the second air suction port d and the pressure in the sliding vane chamber of such air cylinder are both equal to the discharge pressure, such that forces applied to a sliding vane in such air cylinder are balanced along a radial direction and the sliding vane stops in a sliding vane groove, then a piston in such air cylinder just idles rather than compresses, and the enhanced vapor injection compressor 1 operates in a single-rotor operation mode. As shown in FIG. 1 and FIG. 2, when the first pipe port e is communicated with the third pipe port g, the first gaseous refrigerant suction port c and the second gaseous refrigerant suction port d of the enhanced vapor injection compressor 1 are communicated with each other, such that the pressure in the air cylinder communicated with (i.e., being corresponding to) the second gaseous refrigerant suction port d is an intake pressure, i.e. a pressure less than the pressure in the sliding vane chamber of such air cylinder (the pressure in the sliding vane chamber is equal to the discharge pressure), the sliding vane is extended out of the sliding vane chamber under the radial force to contact the piston, so as to make the air cylinder compress normally, and thus the enhanced vapor injection compressor 1 operates in a double-rotor operation mode.

In short, by communicating the first pipe port e with the second pipe port f of the second direction switching assembly 2, or communicating the first pipe port e with the third pipe port g of the second direction switching assembly 2, the operation mode of the enhanced vapor injection compressor 1 can be controlled, i.e., the enhanced vapor injection compressor 1 may compress with a single air cylinder or with two air cylinders simultaneously, so that the operation mode of the enhanced vapor injection compressor 1 can be switched between the single-rotor operation mode and the double-rotor operation mode.

The second direction switching assembly 3 includes a first valve port h, a second valve port i, a third valve port j and a fourth valve port k, in which the first valve port h is communicated with one of the second valve port i and the third valve port j, and the fourth valve port k is communicated with the other of the second valve port i and the third valve port j. That is, when the first valve port h is communicated with the second valve port i, the fourth valve port k is communicated with the third valve port j; or when the first valve port h is communicated with the third valve port j, the fourth valve port k is communicated with the second valve port i.

Preferably, the second direction switching assembly 3 is a four-way valve. When the air conditioning system 100 operates in a refrigerating mode, the first valve port h is communicated with the second valve port i and the third valve port j is communicated with the fourth valve port k. When the air conditioning system 100 operates in a heating mode, the first valve port h is communicated with the third valve port j and the second valve port i is communicated with the fourth valve port k. Certainly, the present invention is not limited to this. The second direction switching assembly 3 may also be configured as another element, as long as four valve ports are provided and the direction switch among them can be realized.

The first valve port h and the fourth valve port k are connected with the gaseous refrigerant discharge port a and the gaseous refrigerant return port n respectively. Refrigerant enters the liquid accumulator 11 from the fourth valve port k of the second direction switching assembly 3 via the gaseous refrigerant return port n, returns to the enhanced vapor injection compressor 1, then turns into the refrigerant of high temperature and high pressure after being compressed in the air cylinder, and the refrigerant of high temperature and high pressure is discharged from the gaseous refrigerant discharge port a to the first valve port h. It shall be noted that a principle of compressing the refrigerant by the enhanced vapor injection compressor 1 is known in the prior art, which will not be elaborated herein.

The first heat exchanger (i.e. the outdoor heat exchanger 4 shown in FIG. 1) has a first end connected with the second valve port i, and the second heat exchanger (i.e. the indoor heat exchanger 5 shown in FIG. 1) has a first end connected with the third valve port j. As shown in FIG. 1, the outdoor heat exchanger 4 has its first end 4*a* connected with the second valve port i, and the indoor heat exchanger 5 has its first end 5*a* connected with the third valve port j.

The flash evaporator 6 has an gaseous refrigerant outlet r and two ports (e.g. a first port s and a second port t shown in FIG. 1). The gaseous refrigerant outlet r is connected with the gaseous refrigerant supplement port b, such that the gaseous refrigerant separated from the flash evaporator 6 may return to the enhanced vapor injection compressor 1 via the gaseous refrigerant supplement port b to be compressed, so as to improve the overall performance of the gaseous refrigerant conditioning system 100. Further, a control valve 9 is connected in series between the gaseous refrigerant outlet r and the gaseous refrigerant supplement port b, such that the gaseous refrigerant outlet r and the gaseous refrigerant supplement port b may be controlled to communicate with each other by the control valve 9 to control the quantity of the gaseous refrigerant coming into the enhanced vapor injection compressor 1 (i.e., to prevent too much gaseous refrigerant from entering the enhanced vapor injection compressor 1), so as to effectively avoid damages of the enhanced vapor injection compressor 1 due to the compression with liquid of the enhanced vapor injection compressor 1.

The two ports are connected with second ends of the first and second heat exchangers respectively, and a throttling element (e.g. a first throttling element 7 or a second throttling element 8 shown in FIG. 1) is connected in series between each port and the corresponding heat exchanger. As shown in FIG. 1, the first port s is connected with the second end 4*b* of the outdoor heat exchanger 4 and the first throttling element 7 is connected in series between the first port s and the outdoor heat exchanger 4; the second port t is connected with the second end 5*b* of the indoor heat exchanger 5 and the second throttling element 8 is connected in series between the second port t and the indoor heat exchanger 5, in which the first throttling element 7 and the second throttling element 8 are used for throttling and reducing pressure.

Preferably, each throttling element is an electronic expansion valve. Certainly, the present invention is not limited thereby. The throttling element may be a capillary or a combination of the capillary and the electronic expansion valve, as long as it serves to throttle and reduce pressure.

With the air conditioning system 100 according to the embodiments of the present invention, an operation mode of the enhanced vapor injection compressor 1 with a variable capacity can be freely switched between the single-rotor operation mode and the double-rotor operation mode, such that the air conditioning system 100 can operate in the double-rotor operation mode to improve the refrigeration or heating speed when a large power output is needed for refrigeration at high temperature and heating at low temperature, and the air conditioning system 100 can also bypasses one rotor to operate in the single-rotor operation mode for refrigeration at low temperature and heating at high temperature, in which case the low power and high energy efficiency can be realized along with slight vibration.

Preferably, the first direction switching assembly 2 is a three-way valve. It can be understood that the first direction switching assembly 2 may be configured as another structure, as long as three pipe ports are provided and the direction control can be realized among them.

It can be understood that the three-way valve may be replaced by another valve with the same function, for example, a four-way valve. The common four-way valve has four ports (referred to as A, B, C and D). In the present invention, the three-way valve may be replaced by the four-way valve in following ways.

1. Port D of the four-way valve is blocked, port B is connected with the second gaseous refrigerant suction port d of the enhanced vapor injection compressor 1 with the variable capacity, port A and port C are connected with the gaseous refrigerant discharge port a and the liquid accumulator 11 of the enhanced vapor injection compressor 1 respectively without a specific connection sequence.

2. Port B of the four-way valve is blocked, port D is connected with the second gaseous refrigerant suction port d of the enhanced vapor injection compressor 1 with the variable capacity, port A and port C are connected with the gaseous refrigerant discharge port a and the liquid accumulator 11 of the enhanced vapor injection compressor 1 respectively without a specific connection sequence.

3. Port A of the four-way valve is blocked, port C is connected with the second gaseous refrigerant suction port d of the enhanced vapor injection compressor 1 with the variable capacity, port B and port D are connected with the gaseous refrigerant discharge port a and the liquid accumulator 11 of the enhanced vapor injection compressor 1 respectively without a specific connection sequence.

4. Port C of the four-way valve is blocked, port A is connected with the second gaseous refrigerant suction port d of the enhanced vapor injection compressor 1 with the variable capacity, port B and port D are connected with the gaseous refrigerant discharge port a and the liquid accumulator 11 of the enhanced vapor injection compressor 1 respectively without a specific connection sequence.

In the following, a method for controlling the air conditioning system 100 according to embodiments of the present invention will be described in detail with reference to FIG. 5 to FIG. 6.

Figure 5:
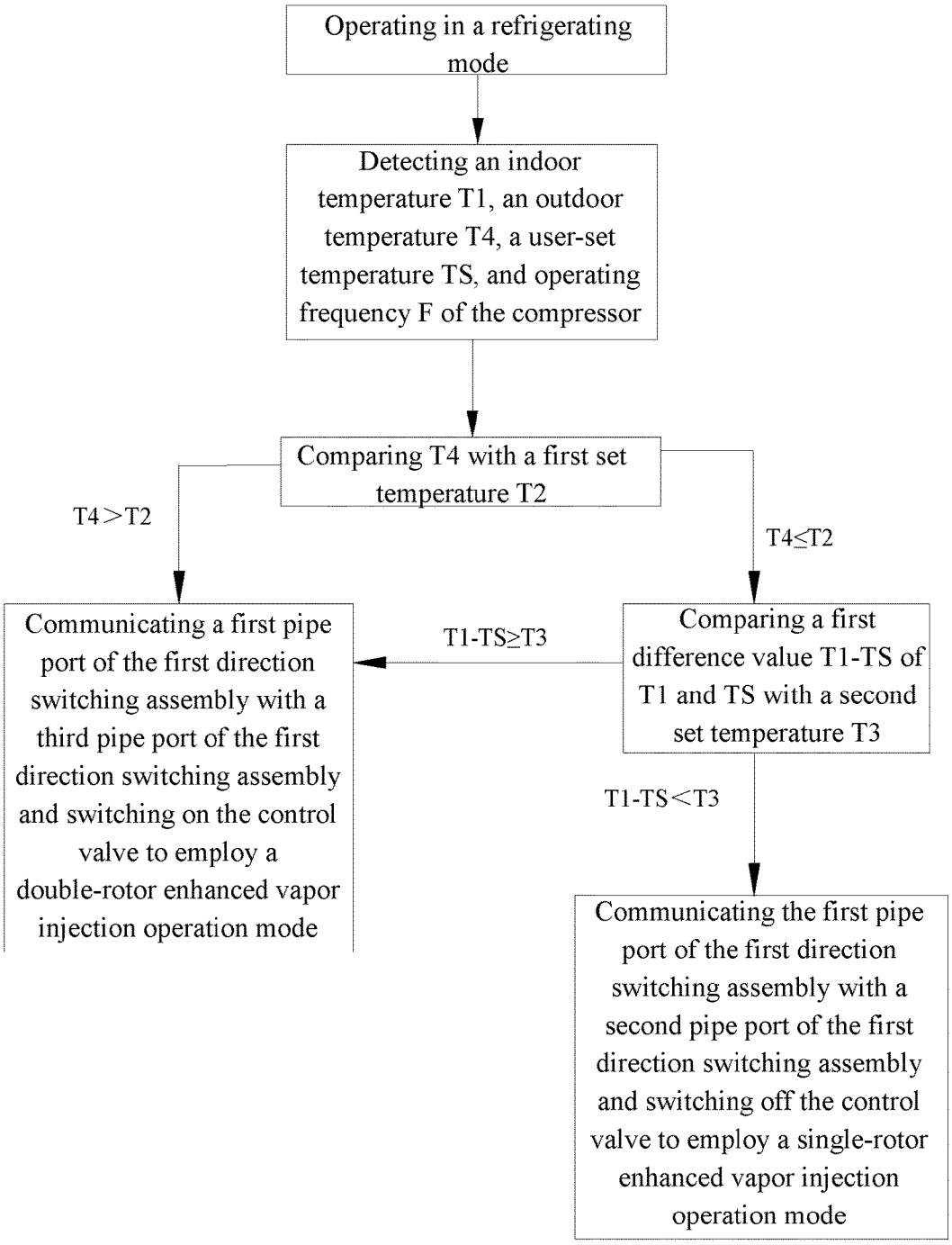
FIG. 5 is a flow chart of a method for controlling an air conditioning system according to an embodiment of the present invention, in which the air conditioning system is in a refrigerating mode.
Figure 6:
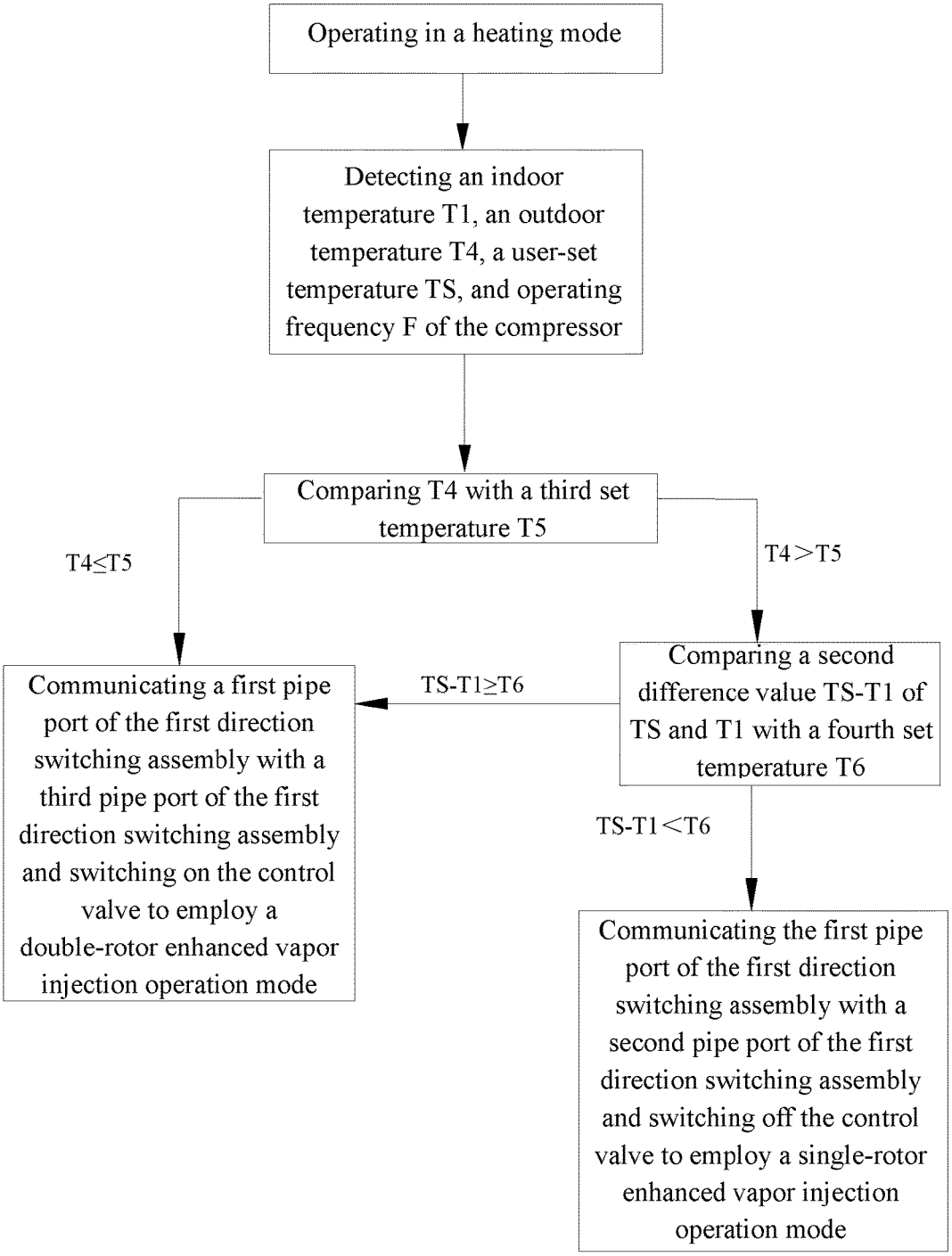
FIG. 6 is a flow chart of a method for controlling an air conditioning system according to an embodiment of the present invention, in which the air conditioning system is in a heating mode.

As shown in FIG. 5 and FIG. 6, the method according to embodiments of the present invention includes the following steps.

An operation mode of the air conditioning system 100, an indoor temperature T1, an outdoor temperature T4, and a user-set temperature TS are detected.

It is detected whether the outdoor temperature T4 is larger than a first set temperature T2 when the air conditioning system 100 operates in the refrigerating mode, and the first direction switching assembly 2 is controlled to communicate the first pipe port e with the third pipe port g to employ a double-rotor enhanced vapor injection operation mode if it is detected that the outdoor temperature T4 is larger than the first set temperature T2; the first direction switching assembly 2 is controlled to communicate the first pipe port e with the third pipe port g to employ the double-rotor enhanced vapor injection operation mode if the outdoor temperature T4 is less than or equal to the first set temperature T2 and it is detected that a first difference value T1-TS between the indoor temperature T1 and the user-set temperature TS is larger than or equal to a second set temperature T3; and the first direction switching assembly 2 is controlled to communicate the first pipe port e with the second pipe port f to employ a single-rotor enhanced vapor injection operation mode if the outdoor temperature T4 is less than or equal to the first set temperature T2 and it is detected that the first difference value T1-TS is less than the second set temperature T3.

It is detected whether the outdoor temperature T4 is larger than a third set temperature T5 when the air conditioning system 100 operates in the heating mode, and the first direction switching assembly 2 is controlled to communicate the first pipe port e with the third pipe port g to employ the double-rotor enhanced vapor injection operation mode if it is detected that the outdoor temperature T4 is less than or equal to the third set temperature T5; the first direction switching assembly 2 is controlled to communicate the first pipe port e with the third pipe port g to employ the double-rotor enhanced vapor injection operation mode if it is detected that the outdoor temperature T4 is larger than the third set temperature T5 and a second difference value TS-T1 between the user-set temperature TS and the indoor temperature T1 is larger than or equal to a fourth set temperature T6; and the first direction switching assembly 2 is controlled to communicate the first pipe port e with the second pipe port f to employ the single-rotor enhanced vapor injection operation mode if it is detected that the outdoor temperature T4 is larger than the third set temperature T5 and the second difference value TS-T1 is less than the fourth set temperature T6.

With the method for controlling the air conditioning system 100 according to embodiments of the present invention, the double-rotor enhanced vapor injection operation mode is employed when the large power output is needed for refrigeration at high temperature and heating at low temperature, so that the large power output is realized at the high compression ratio and the refrigeration or heating speed is improved. The single-rotor enhanced vapor injection operation mode is employed by bypassing one rotor when a small power output is needed for refrigeration at low temperature and heating at high temperature, which may result in slight vibration but realize high energy efficiency with low power, so that when the load of the air conditioning system 100 is relatively small, the air conditioning system 100 can operate continuously to maintain the stability of temperature along with a low temperature fluctuation, which is energy efficient and comfortable.

According to an embodiment of the present invention, the control valve 9 is controlled to be switched on when the first direction switching assembly 2 is controlled to communicate the first pipe port e with the third pipe port g, such that the enhanced vapor injection compressor 1 operates in the double-rotor enhanced vapor injection operation mode, the gaseous refrigerant outlet r of the flash evaporator 6 is communicated with the gaseous refrigerant supplement port b of the enhanced vapor injection compressor 1, and the gaseous refrigerant enters the gaseous refrigerant cylinder to be compressed, so as to improve the compression performance of the gaseous refrigerant conditioning system 100. The control valve 9 is controlled to be switched off when the first direction switching assembly 2 is controlled to communicate the first pipe port e with the second pipe port f, such that the enhanced vapor injection compressor 1 operates in the single-rotor enhanced vapor injection operation mode, in which case the load is small and thus the gaseous refrigerant outlet r is disconnected with the gaseous refrigerant supplement port b, so the gaseous refrigerant is no longer supplied to the enhanced vapor injection compressor 1. Thus, the structure of the air conditioning system 100 may be more reasonable.

According to an embodiment of the present invention, the second set temperature T3 has a same value range as the fourth set temperature T6 to simplify the control program of the air conditioning system 100.

Further, the value range of the second set temperature T3 is from 3° C. to 5° C., and the value range of the fourth set temperature T6 is from 3° C. to 5° C. Thus, when the difference value between the indoor temperature and the user-set temperature is less than the second set temperature T3 or the fourth set temperature T6 which ranges from 3° C. to 5° C., the single-rotor enhanced vapor injection operation mode is utilized to maintain the stability of temperature along with a low temperature fluctuation, which is energy efficient and comfortable.

According to an embodiment of the present invention, since the first set temperature T2 corresponds to a case in which quick refrigeration at a high temperature is needed, and the third set temperature T5 corresponds to a case in which quick heating at a low temperature is needed, the first set temperature T2 may have a value range of 30° C. to 40° C. and the third set temperature T5 may have a value range of 10° C. below zero to 5° C. below zero, so as to make the first set temperature T2 and the third set temperature T5 more reasonable.

In the following, the air conditioning system 100 according to a specific embodiment of the present invention will be described in detail with reference to FIG. 1 to FIG. 6.

Referring to FIG. 1, the air conditioning system 100 includes the enhanced vapor injection compressor 1, the first direction switching assembly 2, the second direction switching assembly 3, the outdoor heat exchanger 4, the indoor heat exchanger 5, the flash evaporator 6, the first throttling element 7, the second throttling element 8 and the control valve 9, in which the first direction switching assembly 2 is the three-way valve, the second direction switching assembly 3 is the four-way valve, the first throttling element 7 and the second throttling element 8 both are electronic expansion valves.

Specifically, as shown in FIG. 1, the enhanced vapor injection compressor 1 includes the casing, the liquid accumulator 11 and the compressing mechanism. The casing is provided with the gaseous refrigerant discharge port a, the gaseous refrigerant supplement port b, the first gaseous refrigerant suction port c and the second gaseous refrigerant suction port d, and the liquid accumulator 11 is provided with the gaseous refrigerant return port n. The three-way valve has the first pipe port e, the second pipe port f and the third pipe port g. The four-way valve has the first valve port h, the second valve port i, the third valve port j and the fourth valve port k. The flash evaporator 6 has the gaseous refrigerant outlet r, the first port s and the second port t.

The first gaseous refrigerant suction port c is communicated with an gaseous refrigerant suction channel of the first air cylinder and the second gaseous refrigerant suction port d is communicated with an gaseous refrigerant suction channel of the second air cylinder. The first valve port h of the four-way valve is connected with the gaseous refrigerant discharge port a, the second valve port i is connected with the first end 4*a* of the outdoor heat exchanger 4, the third valve port j is connected with the first end 5*a* of the indoor heat exchanger 5 and the fourth valve port k is connected with the gaseous refrigerant return port n, and the gaseous refrigerant return port n is communicated with the first gaseous refrigerant suction port c. The first pipe port e of the three-way valve is communicated with the second gaseous refrigerant suction port d, the second pipe port f is communicated with the gaseous refrigerant discharge port a and the third pipe port g connected with the liquid accumulator 11. The control valve 9 is connected in series between the gaseous refrigerant outlet r of the flash evaporator 6 and the gaseous refrigerant supplement port b, the first throttling element 7 is connected in series between the first port s and the second end 4*b* of the outdoor heat exchanger 4, and the second throttling element 8 is connected in series between the second port t and the second end 5*b* of the indoor heat exchanger 5.

When the air conditioning system 100 operates in the refrigerating mode, as shown in FIG. 1 and FIG. 3, the first valve port h and the second valve port i of the four-way valve are communicated with each other, and the fourth valve port k and the third valve port j of the four-way valve are communicated with each other.

A flow direction of the refrigerant is presented as follows. The refrigerant discharged from the gaseous refrigerant discharge port a of the enhanced vapor injection compressor 1 enters the outdoor heat exchanger 4 via the first valve port h and the second valve port i of the four-way valve, exchanges heat with an outdoor environment in the outdoor heat exchanger 4, and then is discharged from the second end 4*b* of the outdoor heat exchanger 4. Then, the refrigerant enters the flash evaporator 6 via the first port s after going through throttling and pressure reduction by the first throttling element 7, and is separated into gaseous refrigerant and liquid refrigerant by the flash evaporator 6.

The liquid refrigerant separated by the flash evaporator 6 flows out of the second port t, enters the indoor heat exchanger 5 after going through throttling and pressure reduction by the second throttling element 8, and exchanges heat with an indoor environment in the indoor heat exchanger 5 to refrigerate the indoor environment. The refrigerant discharged from the indoor heat exchanger 5 passes through the third valve port j and the fourth valve port k of the four-way valve, enters the liquid accumulator 11 via the gaseous refrigerant return port n, and then returns to the enhanced vapor injection compressor 1 via the first gaseous refrigerant suction port c. Such whole process is repeated for refrigeration.

As shown in FIG. 1, when the gaseous refrigerant conditioning system 100 operates in the double-rotor refrigerating mode, the first pipe port e and the third pipe port g of the three-way valve are communicated with each other, such that the refrigerant in the liquid accumulator 11 may pass through the third pipe port g and the first pipe port e, and enter the gaseous refrigerant suction channel of the second air cylinder via the second gaseous refrigerant suction port d to be compressed. The control valve 9 is switched on to communicate the gaseous refrigerant outlet r of the flash evaporator 6 with the gaseous refrigerant supplement port b, such that the gaseous refrigerant separated by the flash evaporator 6 is discharged out of the gaseous refrigerant outlet r, passes through the control valve 9 and the gaseous refrigerant supplement port b and then returns to the enhanced vapor injection compressor 1 to be compressed.

As shown in FIG. 3, when the air conditioning system 100 operates in the single-rotor refrigerating mode, the first pipe port e and the second pipe port f of the three-way valve are communicated with each other, such that the refrigerant discharged from the gaseous refrigerant discharge port a passes through the second pipe port f, the first pipe port e and the second gaseous refrigerant suction port d sequentially and then enters the second air cylinder, to make the pressure in the second air cylinder equal to that in the sliding vane chamber of the second air cylinder, so that the piston in the second air cylinder just idles rather than compresses. The control valve 9 is switched off to cut off a connection pipeline between the gaseous refrigerant outlet r and the gaseous refrigerant supplement port b, such that no more gaseous refrigerant is supplied to the enhanced vapor injection compressor 1.

When the air conditioning system 100 operates in the heating mode, as shown in FIG. 2 and FIG. 4, the first valve port h and the third valve port j of the four-way valve are communicated with each other, and the fourth valve port k and the second valve port i of the four-way valve are communicated with each other.

The flow direction of the refrigerant is presented as follows. The refrigerant discharged from the enhanced vapor injection compressor 1 enters the indoor heat exchanger 5 through the first valve port h and the third valve port j of the four-way valve. The refrigerant in the indoor heat exchanger 5 exchanges heat with the indoor environment to heat the indoor environment. The refrigerant discharged from the indoor heat exchanger 5 enters the flash evaporator 6 after going through throttling and pressure reduction by the second throttling element 8, and is separated into the gaseous refrigerant and liquid refrigerant by the flash evaporator 6.

The liquid refrigerant separated by the flash evaporator 6 enters the outdoor heat exchanger 4 after going through throttling and pressure reduction by the first throttling element 7. The refrigerant in the outdoor heat exchanger 4 exchanges heat with the outdoor environment. The refrigerant discharged from the outdoor heat exchanger 4 passes through the second valve port i and the fourth valve port k of the four-way valve, returns to the liquid accumulator 11 via the gaseous refrigerant return port n, and then returns to the enhanced vapor injection compressor 1 via the first gaseous refrigerant suction port c. Such whole process is repeated to complete heating.

As shown in FIG. 2, when the air conditioning system 100 operates in the double-rotor heating mode, similar to the double-rotor refrigerating mode, the first pipe port e and the third pipe port g of the three-way valve are communicated with each other, and the control valve 9 is switched on.

As shown in FIG. 4, when the air conditioning system 100 operates in the single-rotor heating mode, similar to the single-rotor refrigerating mode, the first pipe port e and the second pipe port f of the three-way valve are communicated with each other, and the control valve 9 is switched off.

In the following, the method for controlling the air conditioning system 100 according to the above embodiment of the present invention will be described in detail.

The first set temperature T2 is set as 32° C., the second set temperature T3 is set as 3° C., the third set temperature T5 is set as 5° C., and the fourth set temperature T6 is set as 3° C.

As shown in FIG. 5 and FIG. 6, the operation mode of the air conditioning system 100, the indoor temperature T1, the outdoor temperature T4, and the user-set temperature TS are detected.

When the air conditioning system 100 operates in the refrigerating mode, as shown in FIG. 5, it is detected whether the outdoor temperature T4 is larger than 32° C. If T4>32° C., the first direction switching assembly 2 is controlled to communicate the first pipe port e with the third pipe port g and the control valve 9 is switched on, so as to employ the double-rotor enhanced vapor injection operation mode. If T4≤32° C. and the first difference value T1-TS between the indoor temperature T1 and the user-set temperature TS is larger than or equal to 3° C. (i.e. T1-TS≥3° C.), the first direction switching assembly 2 is controlled to communicate the first pipe port e with the third pipe port g and the control valve 9 is switched on, so as to employ the double-rotor enhanced vapor injection operation mode. If T4≤32° C. and T1-TS<3° C., the first direction switching assembly 2 is controlled to communicate the first pipe port e with the second pipe port f and the control valve 9 is switched off, so as to employ the single-rotor enhanced vapor injection operation mode.

When the air conditioning system 100 operates in the heating mode, as shown in FIG. 6, it is detected whether the outdoor temperature T4 is larger than 5° C. If T4≤5° C., the first direction switching assembly 2 is controlled to communicate the first pipe port e with the third pipe port g and the control valve 9 is switched on, so as to employ the double-rotor enhanced vapor injection operation mode. If T4>5° C. and the second difference value TS-T1 between the user-set temperature TS and the indoor temperature T1 is larger than or equal to 3° C. (i.e. TS-T1≥3° C.), the first direction switching assembly 2 is controlled to communicate the first pipe port e with the third pipe port g and the control valve 9 is switched on, so as to employ the double-rotor enhanced vapor injection operation mode. If T4>5° C. and TS-T1<3° C., the first direction switching assembly 2 is controlled to communicate the first pipe port e with the second pipe port f and the control valve 9 is switched off, so as to employ the single-rotor enhanced vapor injection operation mode.

With the air conditioning system 100 according to embodiments of the present invention, the enhanced vapor injection compressor 1 with the variable capacity is utilized, such that the double-rotor enhanced vapor injection operation mode can be employed when the large power output is needed for refrigeration at high temperature and heating at low temperature, and thus the large power output can be realized in the case of the high compression ratio and the refrigeration or heating speed is improved; and the single-rotor enhanced vapor injection operation mode can be employed by bypassing one rotor when the small power output is needed for refrigeration at low temperature and heating at high temperature, which may result in slight vibration but realize high energy efficiency with low power, such that when the load of the air conditioning system 100 is relatively small, the air conditioning system 100 may work continuously to maintain the stability of temperature along with a low temperature fluctuation, which is energy efficient and comfortable.

In the specification, it is to be understood that terms such as "central," "upper," "lower," "inner," and "outer" should be construed to refer to the orientation or the position as then described or as shown in the drawings under discussion. These relative terms are only used to simplify description of the present invention, and do not indicate or imply that the device or element referred to must have a particular orientation, or constructed or operated in a particular orientation. Thus, these terms cannot be constructed to limit the present invention.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

Reference throughout this specification to "an embodiment," "some embodiments," "an example," "a specific example," or "some examples," means that a particular feature, structure, material, or characteristic described in connection with the embodiment or example is included in at least one embodiment or example of the present invention. Thus, the appearances of the above phrases throughout this specification are not necessarily referring to the same embodiment or example of the present invention. Furthermore, the particular features, structures, materials, or characteristics may be combined in any suitable manner in one or more embodiments or examples.

Although embodiments of the present invention have been shown and described, it would be appreciated by those skilled in the art that changes, modifications, alternatives and variations can be made in the embodiments without departing from the scope of the present invention. The scope of the present invention is defined by the claims and the like.

What is claimed is:

1. An air conditioning system, comprising:

an enhanced vapor injection compressor comprising a casing, a liquid accumulator and a compressing mechanism provided in the casing, wherein the casing is provided with a gaseous refrigerant port, a gaseous refrigerant supplement port, a first gaseous refrigerant suction port and a second gaseous refrigerant suction port, the liquid accumulator is provided with a gaseous refrigerant return port, the gaseous refrigerant return port is communicated with the first gaseous refrigerant suction port, the first gaseous refrigerant suction port and the second gaseous refrigerant suction port are communicated with gaseous refrigerant suction channels of two air cylinders of the compressing mechanism respectively, and pressure in a sliding vane chamber of one air cylinder of the compressing mechanism corresponding to the second gaseous refrigerant suction port is equal to a discharge pressure at the gaseous refrigerant discharge port;

a first direction switching assembly comprising a first pipe port, a second pipe port and a third pipe port, wherein the first pipe port is connected with the second gaseous refrigerant suction port, the second pipe port is connected with the gaseous refrigerant discharge port and the third pipe port is connected with the liquid accumulator, and the first pipe port is communicated with one of the second pipe port and the third pipe port;

a second direction switching assembly comprising a first valve port, a second valve port, a third valve port and a fourth valve port, wherein the first valve port is communicated with one of the second valve port and the third valve port, the fourth valve port is communicated with the other of the second valve port and the third valve port, and the first valve port and the fourth valve port are connected with the gaseous refrigerant discharge port and the gaseous refrigerant return port respectively;

a first heat exchanger having a first end connected with the second valve port and a second end;

a second heat exchanger having a first end connected with the third valve port and a second end; and a flash evaporator having a gaseous refrigerant outlet, a first port and a second port, wherein the gaseous refrigerant outlet is connected with the gaseous refrigerant supplement port, the first port is connected with the second end of the first heat exchanger, the second port is connected with the second end of the second heat exchanger, a first throttle is connected in series between the first port and the first heat exchanger, a second throttle is connected in series between the second port and the second heat exchanger, and a control valve is connected in series between the gaseous refrigerant outlet and the gaseous refrigerant supplement port.

2. The air conditioning system according to claim 1, wherein the second direction switching assembly is a four-way valve.

3. The air conditioning system according to claim 1, wherein the first direction switching assembly is a three-way valve.

4. The air conditioning system according to claim 1, wherein each of the first throttle and the second throttling element is an electronic expansion valve.

* * * * *